US006397563B1

(12) United States Patent
Hammacher

(10) Patent No.: US 6,397,563 B1
(45) Date of Patent: Jun. 4, 2002

(54) METHOD AND DEVICE FOR PACKAGING FLAT PRODUCTS

(75) Inventor: Heinz-Peter Hammacher, Bamberg (DE)

(73) Assignee: Loesch Verpackungstechnik GmbH & Co. KG, Altendorf (DE)

( * ) Notice: Subject to any disclaimer, the term of this patent is extended or adjusted under 35 U.S.C. 154(b) by 0 days.

(21) Appl. No.: 09/763,949

(22) PCT Filed: Jun. 30, 2000

(86) PCT No.: PCT/EP00/06123

§ 371 (c)(1),
(2), (4) Date: Feb. 28, 2001

(87) PCT Pub. No.: WO01/02250

PCT Pub. Date: Jan. 11, 2001

(30) Foreign Application Priority Data

Jul. 1, 1999 (DE) ..... 199 30 368

(51) Int. Cl.[7] ..... B65B 35/30; B65B 35/50
(52) U.S. Cl. ..... 53/443; 53/447
(58) Field of Search ..... 53/251, 443, 447, 53/475, 534, 540

(56) References Cited

U.S. PATENT DOCUMENTS

| | | | | |
|---|---|---|---|---|
| 3,290,859 A | * | 12/1966 | Talbot | 53/534 |
| 3,786,617 A | | 1/1974 | Fluck | 53/154 |
| 3,832,823 A | * | 9/1974 | Currie | 53/35 |
| 4,633,651 A | | 1/1987 | Edmunds | 53/435 |
| 4,662,152 A | | 5/1987 | Simelunas et al. | 53/246 |
| 4,799,583 A | | 1/1989 | Simelunas et al. | 198/418.1 |
| 4,807,741 A | | 2/1989 | Simelunas et al. | 198/477.1 |
| 4,821,870 A | | 4/1989 | Simelunas et al. | 198/812 |
| 4,843,799 A | | 7/1989 | Simelunas et al. | 53/448 |
| 5,761,883 A | * | 6/1998 | Pruett et al. | 53/448 |

FOREIGN PATENT DOCUMENTS

| | | |
|---|---|---|
| EP | 275420 | 7/1988 |

* cited by examiner

*Primary Examiner*—Scott A. Smith
*Assistant Examiner*—Nathaniel Chukwurah
(74) *Attorney, Agent, or Firm*—Banner & Witcoff, Ltd.

(57) ABSTRACT

A method and apparatus used for packaging flat products in a plurality of trays. According to the method, individual trays are picked from a stack of trays by a suitable device. Several products are fed to a conveyor belt so that they lay flat and one behind the other on the conveyor belt. These products are picked individually one after the other from the conveyor belt and placed into the individual trays. The trays that are filled with the products are delivered on a second conveyor belt for packaging or wrapping. The method and apparatus also facilitate the placement of products in the trays in different arrangements.

28 Claims, 5 Drawing Sheets

METHOD AND DEVICE FOR PACKAGING FLAT PRODUCTS

The invention relates to a method and an apparatus for the packaging of flat products into trays.

SUMMARY OF THE INVENTION

The apparatus according to the present invention is preferably used in the industry of sweets (candies) and durable bakery goods (pastries). Specifically, the apparatus is used for the automatic packaging of sensitive products which may vary greatly in their measurements and shapes. These sensitive products include cakes, biscuits, cookies or chocolate products that are packed into trays with high efficiency. In a preferred embodiment, the trays consist of a more or less rigid plastic sheet or foil that is formed, particularly by being deep-drawn, into a shape that corresponds to the shape and the number of the products to be packed.

The products to be packed are received from ovens or from casting, bar-forming or coating systems whereby the products can be distributed onto the required number of conveyors and, according to the invention, supplied to the devices for inserting them into the trays. The trays are preferably supplied in the form of tray stacks, from which individual trays are denested. The products are individually and successively, one after the other, inserted into the trays. When in the trays, the products lie flat one above the other or generally standing upright one behind the other or also scaled and standing inclined one behind the other. The thus filled trays are then conveyed further and, for example, supplied to an apparatus for introducing them into an outer packaging or for wrapping them.

Intermediate buffers or storage means can be provided in the region where the products are supplied to the trays. In the case of obstacles in the following machine parts, the products can be stored or buffered carefully, for example, by laying them scaled on top of each other.

BRIEF DESCRIPTION OF THE DRAWINGS

Details and advantages of the invention can be seen from the following description of embodiments based on the drawings.

DETAILED DESCRIPTION OF THE INVENTION

Figure 1:
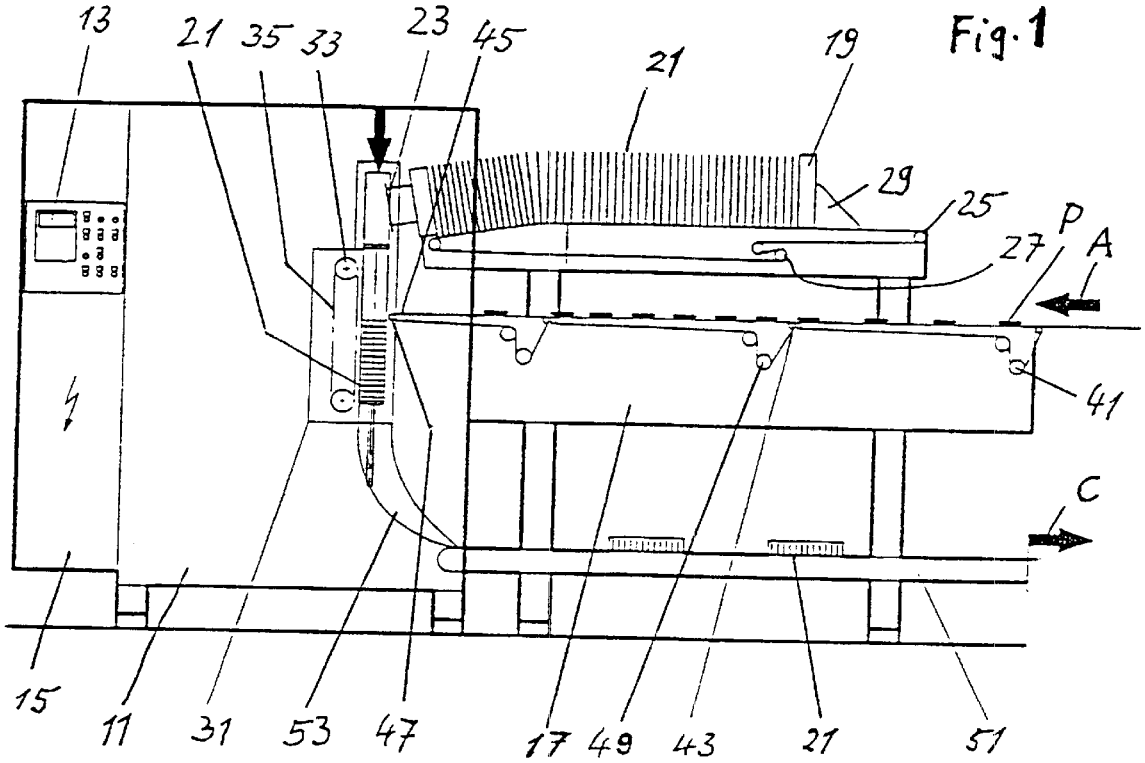
FIG. 1 is a schematic side view of an apparatus according to the invention, by which products arriving in a flat-lying manner can be packed into trays so that they are standing upright or on edge beside each other.

At first the invention with its basic characters will be described with regard to the embodiment of FIGS. 1 and 2. The apparatus according to the invention substantially comprises a machine frame 11 with an operating panel 13 that is provided at the front side of an electrical control box 15. On one side of the machine frame 11 various apparatus parts are provided on a side frame 17. A tray magazine 19 is positioned at an upper side of the side frame 17. In the tray magazine 19, several individual trays 21, stacked substantially vertically behind each other, are supplied in a leftward direction to a denester 23. Suitable conveying means, for example a feeding belt 25 with deflection pulleys 27 and with a slide 29 engaging behind the tray stack, convey the trays 21 in the direction of the denester 23. In the denester 23 the trays are denested individually and transferred to a tray manipulator 31 provided in the machine frame 11. The tray manipulator 31 has suitable drive means for moving the trays 21 in a reciprocating manner. For example, the drive means can include a conveyor belt 35 guided by means of deflection pulleys 33. The machine frame 11 together with the structural parts provided therein constitutes a tray loading arrangement or tray loader.

A first conveyor or supply conveyor 43 for supplying individual products P lying flat one behind the other is positioned below the tray magazine 19 and to the side of the tray manipulator 31. As shown in FIG. 1, the conveyor 43 is, also on the side of frame 17. The conveyor 43 may include a product feeding belt 43 guided by means of deflection pulleys 41. During the operation of the apparatus, the individual products P arrive in the direction of the arrow A lying flat behind each other on the feeding belt 43. According to FIG. 1 at the left end of the conveyor belt 43, the products P are stacked into the trays 21 standing substantially vertically in the tray manipulator 31 such that the products P in the tray 21 are always lying in a stack above each other in a vertical direction. In connection therewith, the tray 21 is moved downwardly always by the height of one product P. The transfer of the products P from the conveyor belt 43 to the trays 21 is made, for example, by means of a sharp deflection 45 of the conveyor belt 43. This sharp deflection, also known as a knife-edge deflection, is caused by a small deflection pulley 47. Further, belt tensioning devices 49 are provided at the conveyor belt 43.

Below the supply conveyor 43 for the products P, a second or discharge conveyor 51 is provided on which the filled or loaded trays 21 are discharged in the direction of the arrow C (discharge conveyor for the discharge of loaded trays). As shown in FIG. 1, the second conveyor 51 is provided at the side frame 17. Also, in one embodiment, second conveyor 51 may be a conveyor belt guided by means of rollers or pulleys. Between the tray manipulator 31 and the second or discharge conveyor 51 there is provided a curved conveyor or transfer conveyor 53 for the individual trays 21. When on the transfer conveyor 53, the trays 21 are turned or sweeped by approximately 90 degrees from the substantially vertical feed position to a substantially horizontal position. The products P, lying at first in the form of a vertical stack one above the other in the tray 21, stand on edge in or on the trays 21 turned by 90 degrees with the trays when on conveyor 51.

Figure 2:
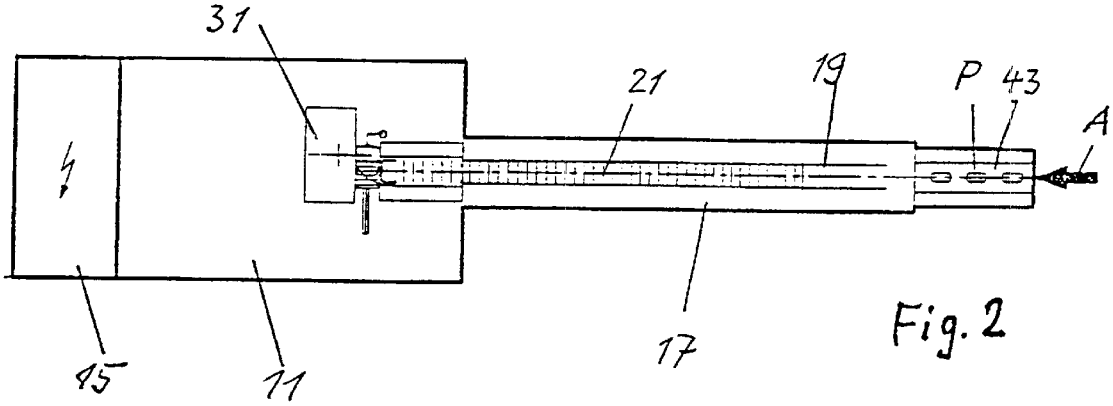
FIG. 2 is a schematic top plan view of the apparatus of FIG. 1.

FIG. 2 shows the substantial details of the apparatus of FIG. 1 in a schematic plan view from above.

Figure 3:
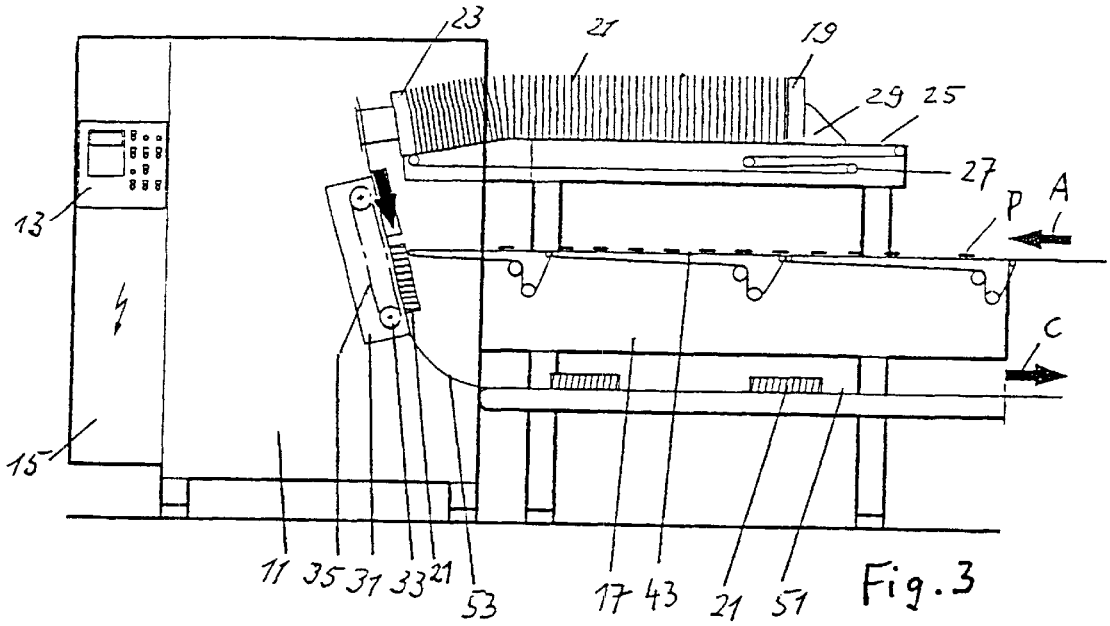
FIG. 3 is a schematic side view of an apparatus according to the invention by which products arriving in a flat-lying manner can be packed into trays so that they are standing inclined one behind the other, i.e., scaled.
Figure 4:
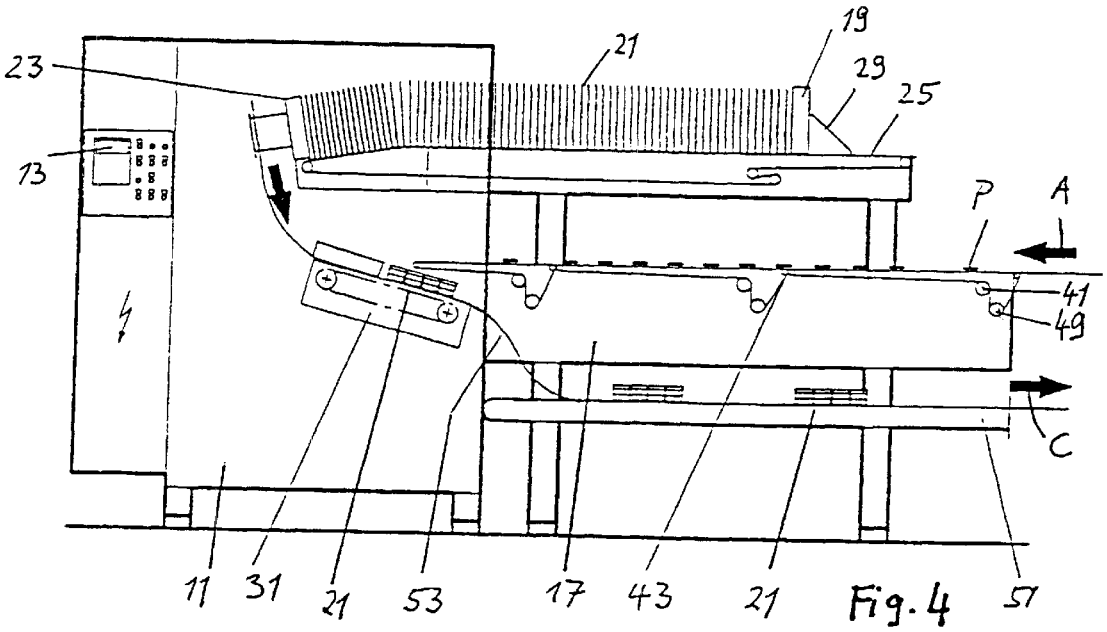
FIG. 4 is a schematic side view of an apparatus according to the invention, by which products arriving in a flat-lying manner can be packed into trays so that they are lying flat one above the other and in individual stacks beside each other.
Figure 5:
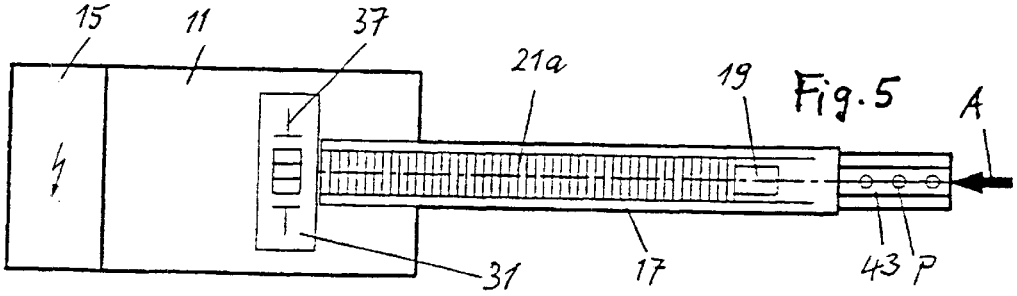
FIG. 5 is a schematic top plan view of the apparatus of FIG. 3 and FIG. 4.

In FIGS. 3, 4 and 5 the same or corresponding structural parts are provided with the same reference numbers as in FIGS. 1 and 2. The differences between the devices of FIGS. 3–5 and those of FIGS. 1 and 2 are described below.

The tray manipulator 31 is pivotally arranged about a horizontal axis so that, as shown in FIG. 3, the individual products P arriving on the supply conveyor 43 are introduced into inclined trays 21. The trays 21 are positioned by and correspondingly angled with the tray manipulator 31 that, as shown in FIG. 3, is slightly inclined with regard to the vertical direction. The products P then lie flat in the tray manipulator 31 in an almost vertical stack but slightly offset with regard to each other in the individual tray 21. The filled or loaded tray 21 is moved downwardly from the inclined position and, at the same time, turned by the transfer conveyor 53 such that the tray 21 is positioned horizontally on the discharge conveyor 51. The individual products P then stand scaled on edge one behind the other in the tray 21. For this purpose the tray 21 at its bottom and/or at its lateral walls can be provided with corresponding inclined holding projections for the products P.

FIG. 4 shows another possible use for the inventive apparatus according to FIGS. 1 to 3. In this embodiment, the tray manipulator 31 is pivotable about a horizontal axis such that the individual trays 21 denested by the denester 23 are only slightly inclined with regard to the horizontal direction on the tray manipulator 31. The individual products P arriving on the supply conveyor 43 are introduced into the tray 21 by the knife-edge deflection 45, 47 such that they are positioned in the tray parallel to its bottom. In this connection, the tray manipulator 31 can control and move the tray 21 reciprocally such that the products P are individually positioned in a single layer, one behind the other on the tray 21. However, the tray 21 can also be moved reciprocally and controlled by the tray manipulator 31 such that several individual layers of products P, one after the other, can be positioned onto the tray 21. As a result, the individual stacks of products P are positioned one behind the other on the tray 21 in the conveying direction. These product stacks become higher with each supplied layer of products P. The tray manipulator 31, however, can also be controlled and moved such that initially only one single stack of products P is positioned on the forward or front (right) end of the tray 21, whereafter then a second, a third and possibly further product stacks are formed on the tray 21. The products P are always individually supplied to the stacks such that one stack after the other is formed and the tray 21 is correspondingly moved forward for each stack.

In the tray manipulator 31, the transfer conveyor 53 can be flexibly or bendably arranged in such a manner that (in the embodiment of FIG. 4) the already almost horizontally lying trays 21 are transferred downwardly by a somewhat steeper section of the transfer conveyor 53. Additional parts of the transfer conveyor 53 cause the trays 21 to move in the horizontal direction as they are transferred onto the discharge conveyor 51. When on the discharge conveyor 51 the trays 21 are positioned horizontally one behind the other. In this position, the individual products P can lie on the trays 21 side-by-side in a flat position and stacked above each other.

FIG. 5 shows a plan view of a possible modified embodiment of the apparatus according to the invention. Here, trays 2 la that have multiple rows are used. At the tray manipulator 31 a shifting module 37 is provided for the multi-row trays by which the trays 21*a* can be shifted transverse to their main conveying direction and transverse to the supply direction A of the individual products P. As a result, the individual products P can be inserted successively into each row of the trays 21*a*.

Figure 6:
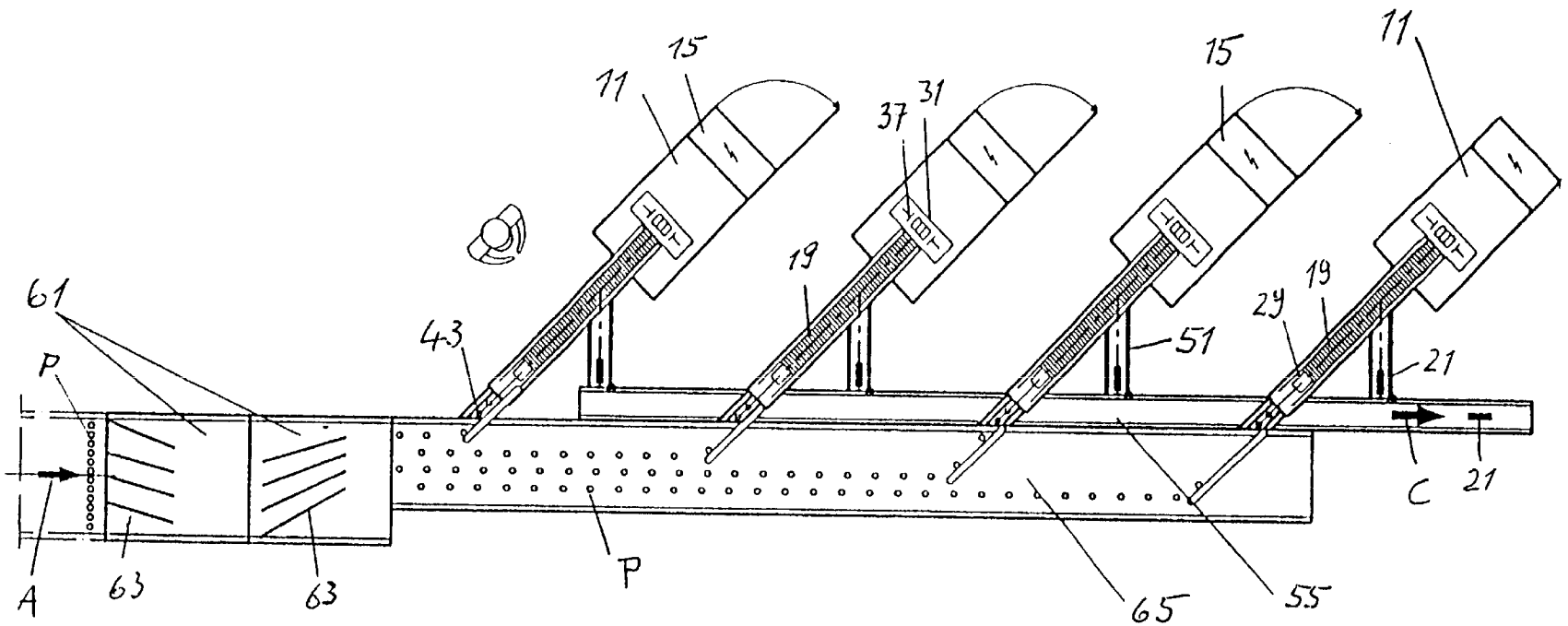
FIG. 6 is a schematic plan view of an apparatus according to the invention by which products arriving in several rows on a common conveyor can be packed into trays in individual rows.
Figure 7:
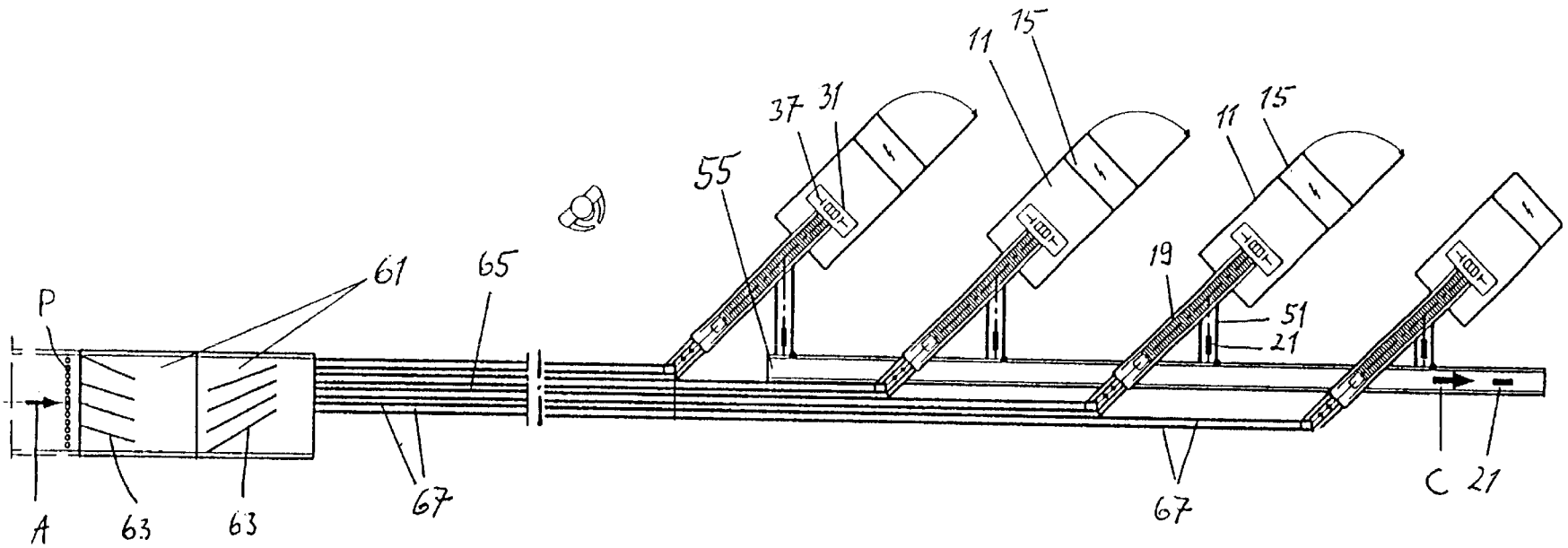
FIG. 7 is a schematic plan view of an apparatus substantially corresponding to FIG. 6, however, with an additional product buffer in the path of the arriving products.
Figure 8:
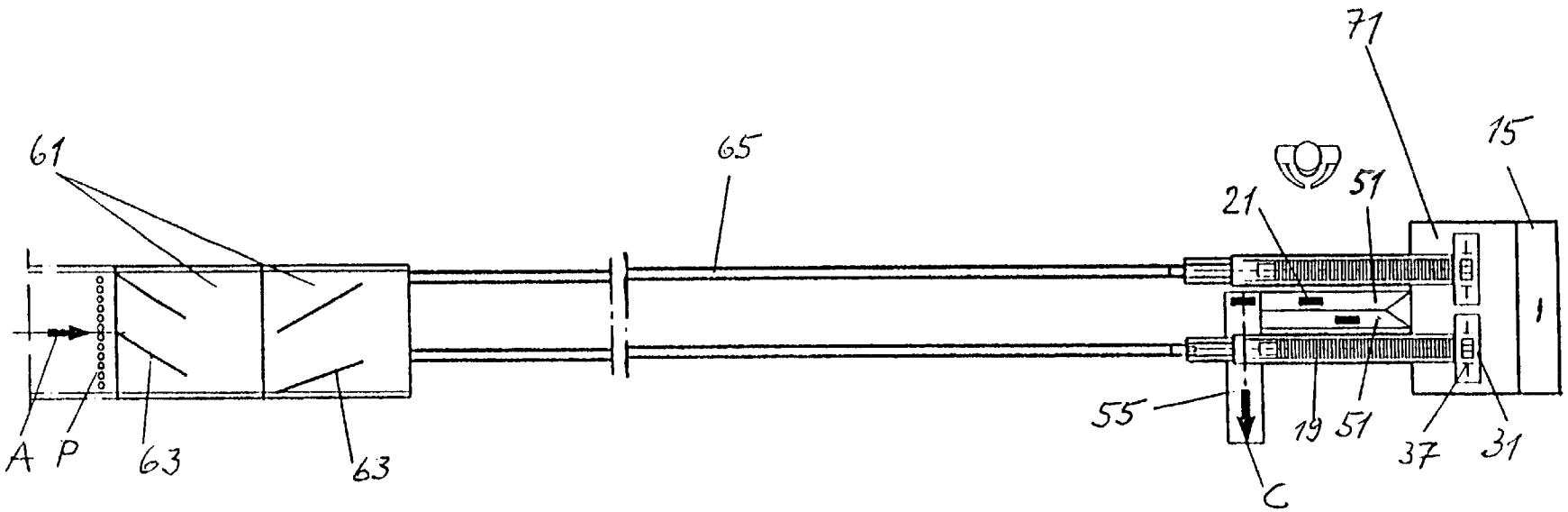
FIG. 8 is a schematic view of an apparatus according to the invention with two supply conveyors, each with a product buffer.

In FIGS. 6, 7 and 8 the same or corresponding structural parts are provided with the same reference numbers as in the previous figures. The differences between the illustrated apparatus and those of the previous figures will be described below.

So far it was assumed that the products P were being supplied in the direction of the arrow A in one single row, and one after the other. According to FIG. 6, however, the products P can also be supplied in several rows and beside each other. By way of sorting devices 61, the arriving products P are sorted by a product feeding and distribution system 65 provided by the first conveyor or the supply conveyor, respectively, into several rows of products P traveling parallel to each other. The sorting devices can include aligning belts with guiding surfaces or baffles 63 arranged there above. The product feeding and distribution system 65 is associated with several tray loaders that correspond in number to the individual rows of products P. The tray loaders are each illustrated by their machine frame 11 with associate control box 15. Each of these tray loaders has its own tray magazine 19, if applicable with a shifting or displacement module 37 for the transverse movement of multi-row trays 21. Each tray loader has its own supply conveyor or conveyor belt 43 for receiving the products P in one single row, or, in an alternative embodiment, in several parallel rows, from the first conveyor 65 and for supplying the products P to the corresponding tray manipulator 31.

After the loading of the individual trays 21 in the manner described above, the filled trays 21 are transported on individual discharge conveyors 51, associated with each tray loader, to a collecting conveyor or a collecting transport 55. The individual trays 21 are then discharged in the direction of the arrow C for further packaging. The individual tray loaders characterized by the reference number 11 for the machine frame furthermore are designed as it has been described in connection with the FIGS. 1 to 5.

The apparatus according to FIG. 7 corresponds largely to that of FIG. 6. Here the product feeding and distribution system 65 has several separate rows parallel to each other and separated from each other, for example, by partition walls 67. These partition walls 67 on the product feeding and distribution system 65 form product buffers in the individual parallel rows formed by the partition walls 67 that are long enough in the conveying direction to receive or store the arriving products P. In the product buffers created by the walls 67, the individual products can be stored so that they lie flat behind each other or are scaled above each other. Hereby, a sensitive treatment of the products is assured. For the rest, the design of the apparatus according to FIG. 7 corresponds to that of FIG. 6.

FIG. 8 shows an apparatus in which the products P arriving in the direction of the arrow A are distributed by two sets of two guiding surfaces or baffles 63. As shown in FIG. 8, a baffle 63 is arranged behind another baffle 63 on two supply conveyors 65 that, due to their length in the conveying direction, can again serve as product buffers. At the end of each of these first conveyors 65 there is provided a tray loading station or tray loader 71 mounted within a common machine frame 11. The tray loaders 71 in this embodiment have two tray magazines 19 extending parallel to each other, each with an associate tray manipulator 31. From each tray manipulator 31 the trays 21 loaded with products P are first transported away on an associated discharge conveyor. The two discharge conveyors 51 convey the trays 21 to a common collecting conveyor 55 on which the loaded trays 21 are transported away in the direction of the arrow C for further packaging.

Thus, by the invention a modular machine concept is provided in which the individual components can be used alone for themselves or commonly in a multiple arrangement. Thereby, this concept is particularly suitable for the specific requirements of the industry of sweets and permanent bakery goods. Each individual supply conveyor or conveyor belt can be controlled separately through the control box 15 by means of the operating panel 13. Frequency controlled drives can be used for the supply and transport conveyors, for the buffer conveyors and for the tray manipulators 31. The kind and the number of the products P per tray 21 differ from operation to operation. The kind and number of products P per tray 21 can be programmed by inputting information into the apparatus via the operating panel 13. In case of a product change, only a few machine elements need be adjusted. This is a simple procedure to accomplish. All parts coming into contact with the products can be designed in materials compatible with food and edible goods, for example, stainless steel or suitable plastics. Altogether, the apparatus has a solid, rugged and reliable design.

The particular advantages of the method according to the invention and of the apparatus used for it, respectively, are established in that the modular system is very flexible and can easily be adjusted to different products. The products are treated in a particularly sensitive manner by feeding, counting and handling them without pressure, i.e., without mutual transport pressure, and thus without the use of grippers (pick-ups) or special separating devices. Also, even when the products include irregularities, an exact number of products for each tray still exist. By means of the integrated product buffer the entire system has the highest possible availability, whereby alternatively also stand-by modules can be envisaged. By the modular design of the apparatus, it is tailored for each type of use. All elements of the apparatus can be designed so that they are accessible in an optimal manner for the easy operation and the maintenance of the apparatus. Finally, the overall system has a very good price-efficiency-ratio. With a maximum outfit or provision of requisite equipment, all conceivable formations of packings and presentations of products can be realized in the single apparatus system according to the present invention. Finally, devices for removing or transferring deformed or damaged products away from the apparatus can be provided at suitable places.

What is claimed is:

1. A method for packaging flat products into trays, said method comprising the steps of:

obtaining individual trays from a stack of trays;

supplying products on a first conveyor such that the products lie flat on the first conveyor and at least a plurality of the products are aligned along a length of the first conveyor;

individually inserting a plurality of the products into each tray; and transporting each of the trays to a second conveyor after it has been filled with a plurality of the products so that the trays containing the products move with the second conveyor along a path of travel defined by a portion of the second conveyor.

2. The method according to claim 1 wherein said inserting step includes individually positioning the trays in a loading position, and wherein said trays are moveable in a reciprocating manner along a transport path between at least two points when in said loading position.

3. The method according to claim 1 wherein said inserting step occurs when each one of the trays is at a first position, and said method further includes the steps of:

moving each of the trays from the first position to a second position; and inserting a plurality of products into each tray at a location within the respective tray that is spaced from the products inserted at the first position so that at least two stacks of products are positioned in each tray.

4. The method according to claim 1 wherein said inserting step includes the steps of:

inserting a first row of products within a respective one of the trays;

moving the respective one of the trays forward along a transport path by a distance including an amount of spacing desired between adjacent products as the products of said first row are being inserted;

moving said respective tray rearward along the transport path for a distance that is substantially equal to the length of the respective tray; and moving said tray forward along the transport path while inserting a second row of products on top of said first row of products so that said respective tray includes at least two layers of products in at least two stacks.

5. The method according to claim 1 wherein the trays include multiple rows for receiving the products, and wherein the trays are moveable in a direction that extends at an angle to a longitudinal direction of the first conveyor.

6. The method according to claim 1 further including the step of providing the products on the first conveyor in a plurality of rows such that the products from a first one of the rows are positioned adjacent the products of a second one of the rows.

7. The method according to claim 6 wherein the providing step includes the steps of:

supplying the products from the first row to a first tray loading station;

supplying the products from the second row to a second loading station; and said transferring step includes transferring the trays from the first and second loading stations to the second conveyor.

8. The method according to claim 1 wherein the first conveyor serves as a product buffer for storing products prior to the inserting step.

9. The method according to claim 8 further including the step of positioning the products in the product buffer formed by the first conveyor in a scaled manner so that one of a pair of the products in the buffer is positioned in front of the other of the pair, and one of the pair of the products in the buffer is positioned above the other of the pair.

10. An apparatus for packing flat products in trays, said apparatus comprising:

a tray magazine for receiving a stack of the trays, a tray denester for denesting individual trays from the stack of trays, a first conveyor for supplying products toward individual denested trays, a device that cooperates with said first conveyor to insert products from the first conveyor into the denested trays, a second conveyor for transporting the trays after the trays have been filled with the products, and a tray holding and transferring device for holding the trays while the trays are being loaded with the products and for transferring the filled trays to the second conveyor.

11. The apparatus according to claim 10 wherein the tray holding and transferring device is rotatable between a first position in which the trays are capable of standing substantially parallel to a vertical direction and a second position in which the trays are capable of being inclined with respect to the vertical direction; and further including a transfer conveyor for transferring loaded trays from the tray holding and transferring device to the second conveyor.

12. The apparatus according to claim 11 wherein the tray holding and transferring device is movable from a loading position to a substantially horizontal transferring position for transferring the loaded trays to either the transfer conveyor or the second conveyor.

13. The apparatus according to claim 10 wherein the tray holding and transferring device includes a device for reciprocally moving the trays along a transfer path.

14. The apparatus according to claim 10 wherein the tray holding and transferring device includes a device for shifting the trays in a direction that is transverse to a longitudinal axis of the first conveyor.

15. The apparatus according to claim 10 wherein the tray holding and transferring device includes a device for shifting the trays in a direction that is transverse to a transfer path of the trays.

16. The apparatus according to claim 10 wherein the first conveyor includes a plurality of rows and a plurality of parallel extending individual supply conveyors, each said individual supply conveyor being associated with a respective one of the rows; and further including a plurality of sorting and guiding devices that each deliver products to a corresponding one of said individual supply conveyors.

17. The apparatus according to claim 16 wherein the rows each include at least one row conveyor that leads to a corresponding tray loading station, each said corresponding tray loading station including a corresponding tray magazine and a discharge conveyor, and wherein said second conveyor is capable of receiving filled trays from a plurality of the discharge conveyors.

18. The apparatus according to claim 10 wherein the first conveyor includes a product buffer for storing a plurality of the products.

19. The apparatus according to claim 10 wherein the first conveyor includes a conveyor belt with a sharp deflection at one end for transferring the products into the trays.

20. The apparatus according to claim 19 wherein the sharp deflection is a knife-edge deflection.

21. The apparatus according to claim 19 wherein the supply conveyor includes belt tensioning devices.

22. The apparatus according to claim 10 wherein the number of products supplied to each tray can be adjusted by a control program.

23. The apparatus according to claim 10 wherein drives of the first and second conveyors can be separately adjusted by a control program.

24. The apparatus according to claim 10 wherein drives of the first conveyor and the tray holding and transferring device can be separately controlled.

25. A method for packaging flat products into trays, said method comprising the steps of:

obtaining individual trays from a stack of trays;

supplying products on a first conveyor such that the products lie flat on the first conveyor and at least a plurality of the products are aligned along a length of the first conveyor;

individually inserting a plurality of the products into respective substantially vertically standing trays so that at least one of the products in one of the trays is positioned above another of the products within the same tray;

transporting each of the trays to a second conveyor after it has been filled with a plurality of the products;

turning said substantially vertically standing trays about ninety degrees; and transferring said trays onto said second conveyor so that the products within at least one tray stand substantially vertically on edge and one in front of the other.

26. A method for packaging flat products into trays, said method comprising the steps of:

obtaining individual trays from a stack of trays;

supplying products on a first conveyor such that the products lie flat on the first conveyor and at least a plurality of the products are aligned along a length of the first conveyor;

individually inserting the products into the trays; and transporting each of the trays to a second conveyor after it has been filled with a plurality of the products;

wherein said inserting step includes individually inserting a plurality of the products into respective trays that are inclined relative to a vertically extending axis so that at least one of the products in one of the trays is positioned above another of the products within the same tray, and said transporting step includes the step of horizontally transferring said inclined trays on to the second conveyor so that the products within at least one of the trays stand inclined to the vertical axis and at least one of the inclined products is scaled behind another of the inclined products; and turning said inclined trays less than ninety degrees before the inclined trays are transferred.

27. A method for packaging flat products into trays, said method comprising the steps of:

obtaining individual trays from a stack of trays;

supplying products on a first conveyor such that the products lie flat on the first conveyor and at least a plurality of the products are aligned along a length of the first conveyor;

individually inserting the products into the trays; and transporting each of the trays to a second conveyor after it has been filled with a plurality of the products, wherein said inserting step includes individually inserting a plurality of the products into respective trays that are inclined with respect to a horizontal axis so that at least one of the products in one of the trays is positioned behind another of the products within the same tray, and said transporting step includes the step of transferring said inclined trays onto the second conveyor so that the products within at least one of the trays lie flat and at least one of the flat lying products is positioned behind another of the flat lying products.

28. A method for packaging flat products into trays, said method comprising the steps of:

obtaining individual trays from a stack of trays;

supplying products on a first conveyor such that the products lie flat on the first conveyor and at least a plurality of the products are aligned along a length of the first conveyor;

individually inserting the products into the trays; and transporting each of the trays to a second conveyor after it has been filled with a plurality of the products, wherein said inserting step includes individually inserting a plurality of the products into respective trays that are inclined with respect to a horizontal axis so that at least one of the products in one of the trays is positioned above another of the products within the same trays, and said transporting step includes the step of transferring said inclined trays onto the second conveyor so that the products within at least one of the trays lie flat and at least one of the flat lying products is positioned above another of the flat lying products.

* * * * *